United States Patent [19]

Suzuki et al.

[11] Patent Number: 5,033,534

[45] Date of Patent: Jul. 23, 1991

[54] METHOD FOR CONTINUOUS CASTING OF STEEL

[75] Inventors: Mikio Suzuki; Toru Kitagawa; Shinobu Miyahara; Akio Nagamune; Yoshiyuki Kanao; Norio Ao; Hironori Yamamoto, all of Kawasaki, Japan

[73] Assignee: NKK Corporation, Tokyo, Japan

[21] Appl. No.: 487,758

[22] Filed: Mar. 2, 1990

[51] Int. Cl.[5] ..... B22D 27/02

[52] U.S. Cl. ..... 164/468; 164/504

[58] Field of Search ..... 164/502, 504, 466, 468

[56] References Cited

U.S. PATENT DOCUMENTS 4,495,984 1/1985 Kollberg ..... 164/468

FOREIGN PATENT DOCUMENTS 265796 5/1988 European Pat. Off. ..... 164/468

1-289543 11/1989 Japan ..... 164/466

OTHER PUBLICATIONS 1. 68-S 270 Nagai et al., Iron and Steel, 1982.
2. 68-S 920 Suzuki et al., Iron and Steel, 1982.
3. 72-S 718 Ozuka et al., Iron and Steel, 1986.

*Primary Examiner*—Kuang Y. Lin

*Attorney, Agent, or Firm*—Frishauf, Holtz, Goodman & Woodward

[57] ABSTRACT

A method for continuous casting of steel comprises charging molten steel from a tundish into a mold through exit ports of an immersion nozzle, introducing a magnetic field vertically to a flow of the molten steel from the exit ports by the use of at least a pair of direct current magnets which are arranged on the outer side of copper plates on the wide side of the mold, the immersion nozzle being placed between the direct current magnets and polarities of magnetisms on the top side of the magnets being the same, and casting the molten steel at a predetermined casting rate. One magnetic pole of the direct current magnet is positioned at an upper end of copper plate on the wide side of the mold and the other magnetic pole being positioned at lower than the exit port of the immersion nozzle and on the outer side of copper plate on the wide side of the mold. The immersion nozzle has two exit ports, each of which has an angle of 15° to 45° downward. The direct current magnetic field is controlled within the range of 1000 to 4000 gauss.

16 Claims, 8 Drawing Sheets

METHOD FOR CONTINUOUS CASTING OF STEEL

BACKGROUND OF THE INVENTION

1. Field of the Invention

The present invention relates to a method for continuous casting of steel, and more particularly to a method for controlling a flow of molten steel fed from an immersion nozzle into a mold for continuous casting of steel by the use of magnetic force.

2. Description of the Prior Arts

FIG. 7 is a schematic illustration showing a flow of molten steel from an immersion nozzle into a mold in a slab continuous caster. Mold powder floats on the surface of the molten steel 8 inside the mold 1. The mold powder presents the molten steel 8 from being oxidized, provides thermal insulation of the molten steel 8, provides lubrication between solidified shell 9 and the mold 1 and absorbs non-metallic particles in the molten steel. The mold powder on the side of molten steel surface is in the state of being melted by the heat of the molten steel 8. The mold powder on the atmospheric side covers the surface of the molten steel 8 in the form of powder 7. Molten powder 6 flows between the solidified shell 9 and the mold 1 and plays the role of a lubricant. The molten powder 6 is replenished at a rate of its consumtion since it is consumed as the libricant. The thickness of the mold powder layer is controlled to be a predetermined value. Immersion nozzle 2 is vertically positioned at the central portion of the mold 1. Exit ports 3 arranged at the end of the immersion nozzle 2 have an opening facing narrow side walls of the mold 1. The molten steel is poured from the exit port 3. Flow 4 of the poured molten steel moves downward obliquely toward the narrow side wall of the mold. The flow 4 of the poured molten steel strikes the narrow side wall of the mold and is divided into an upward flow and a downward flow, that is, turn-over flow 11 and penetration flow 12. The turn-over flow 11 rises along the narrow side wall of the mold and becomes a cause of a wavy motion of a molten steel surface near the narrow side wall of the mold. FIG. 8 is a schematic illustration showing the wavy motion of molten steel surface inside the mold. The flow poured from the exit port 3 of the immersion nozzle 2 is divided into the turn-over flow 11 and the penetration flow 12. The turn-over flow 11 reaches the molten steel surface and causes the level of the molten steel surface to fluctuate. Fluctuation of the molten steel surface gives rise to the wavy motion of the molten steel surface. The wavy motion of the molten steel surface is measured by means of eddy current type distance measuring device 15. The voltage signal is filtered, by which high frequency elements are removed. The voltage signal, from which the high frequency elements have been removed, is measured by means of a millivoltmeter. The eddy current type distance measuring device 15 is arranged above the molten steel surface near the narrow side of the mold as shown in FIG. 8. FIG. 8 is a schematic illustration showing the wavy motion of the molten steel for about one minute. The molten steel surface continuously rises or falls. The level of the wavy motion of the molten steel for one minute is measured. The maximum value of the level of the wavy motion of the molten steel is regarded as the maximum height "h" of a wave of the molten steel surface and a data processing is carried out. In a high rate casting, wherein molten steel of 3 ton/min or more is poured, a flow rate of molten steel poured from the exit port 3 of the immersion nozzle 2 is large. The turn-over flow 11 of molten steel which is produced after the flow of poured molten steel has struck the solidified shell 9 also is large and causes a large wavy motion of molten steel to be formed. FIG. 10 is a graphical representation designating the relationship between the maximum height of the wavy motion of molten steel surface and the index of surface defect of hot-rolled steel plate. As clearly seen from FIG. 10, the ratio of occurrence of the surface defect of hot-rolled steel plate is small when the maximum height of wavy motion of molten steel surface is within a range of 4 to 8 mm. The range of 4 to 8 mm of the maximum height of wavy motion of molten steel surface is preferable. In case the wavy motion of molten steel surface is large, molten powder 6 is easily trapped by the molten steel by the wavy motion of molten steel surface and suspended in the molten steel. The molten powder 6 having been trapped by the molten steel rises on the surface of molten steel due to a difference in the specific weights of the molten steel and the molten powder 6, but some of the molten powder 6 is caught by the solidified shell 9. On the other hand, when the wavy motion of molten steel surface is small, a small amount of new molten steel is fed to the molten steel surface. In consequence, the mold powder 5 is hard to melt. Accordingly, it is hard for the inclusions to be melted and adsorbed into the molten powder 6. The inclusions are caught by the solidified shell 9 and are liable to be inner defect of a slab. The values of 4 to 8 mm which are the preferable range of the maximum height of molten steel surface were obtained by experience in operations of continuous casting. The form and the pouring angle of the immersion nozzle 2, clogging in the immersion nozzle 2 and the width of the mold 1 are specified so that the maximum height of wavy motion of molten steel surface can be within said range.

Recently, however, the operations shown below have been carried out and operation conditions have changed to increase productivity in the continuous casting of steel.

(a) The multiple continuous casting of steel in which several charges of casting are continuously carried out by the use of one tundish and one immersion nozzle.

(b) The change of widths of mold during the continuous casting of steel.

(c) The change of casting rate from a low value to a high value.

As the result of the change of the aforementioned operation conditions, the form and the pouring angle of the immersion nozzle, set for the initial operation, does not fit to the successive operation conditions, which leads to the incapability of the control of the level of the molten steel to the most pertinent range.

Two methods are known to control the height of wavy motion of a molten steel surface. The prior art method 1 disclosed in Nagai Iron and Steel 685270(1982) is a method wherein a flow of molten steel poured from two exit ports is braked by a direct current magnetic field. Two pairs of direct current magnets are arranged inside a cooling box positioned on a surface on the wide side of a mold and introduce a direct current magnetic field to the flow of molten steel poured from the immersion nozzle. The flow of molten steel is controlled by magnetic force produced in the direction opposite to the flow of molten steel induced in the molten steel by the electric current and direct current magnetic field. The prior art method 2 is a method wherein direct current magnetic field is introduced at the molten steel surface. The height of wavy motion of the molten steel surface in the magnetic field is controlled by arranging a direct current magnet at the position of the molten steel surface and horizontally introducing the direct current magnetic field to the molten steel surface. The prior art method 1 is disclosed in "Iron and Steel" (1982), Nagai et al., 68, S 270, and "Iron and Steel" (1982), Suzuki et al., 68, S 920. The prior art method 2 is disclosed in "Iron and Steel" (1986), Ozuka et al., 72, S 718.

The flow of molten steel poured from the immersion nozzle strikes the solidified shell and is divided into an upward turn-over flow and a downward penetration flow. Since kinetic energy which the upward turn-over flow has oscillates the molten steel surface, a wavy motion of the molten steel surface is formed.

However, in the prior art method 1, a direct current magnetic field is introduced perpendicular to the flow of molten metal poured from the immersion nozzle only in the portion between the immersion nozzle and the surface of the narrow side of the mold. The flow of molten metal is braked. In this method, because the flow disperses after it has been poured from the immersion nozzle, and thus a strong direct current magnetic field has to be introduced to control the dispersing flow of poured molten steel. Since the direct current magnetic field is required to control the wide range of dispersing flows in the poured molten steel, large sized equipment is required, by which the production cost is increased. Moreover, in prior art method since a circuit of the eddy current, formed by the mutual work of the flow of molten steel with the direct current magnetic field, is formed in the molten steel in this method, the current density cannot be increased. Accordingly, to generate a great braking force, the magnetic flux density should be increased. The cost of the equipment is increased to increase the magnetic flux density.

The wavy motion is most easily controlled in the prior art method 2 since the direct current magnetic field is directly introduced against the wavy motion of molten steel surface. However, the position where the wavy motion of the molten steel surface is most violent is situated within the range of 100 mm from the narrow side of the mold. Accordingly, the direct current magnetic field is introduced to the range of 100 mm from the narrow side of the mold. A device for generating a magnetic field is required to be placed on the reverse side of a wide side copper plate of the mold and in the position about 100 mm away from the upper end of the wide side of the mold. In case when the device for generating a magnetic field is placed in the above-mentioned position, a large scale revamp of the cooling box is necessary and the direction of cooling path on the copper plate of the mold is required to be made transverse. Then, the wide side copper plate of the mold is insufficiently cooled.

SUMMARY OF THE INVENTION

It is an object of the present invention to manufacture products having good surface properties by decreasing a wavy motion of molten steel surface inside a mold to prevent mold powder from being trapped by the molten steel and to make inclusions in molten steel rise to a molten steel surface by making a depth of penetration of the inclusions small.

To accomplish the foregoing object, the present invention provides a method for continuous casting of steel comprising:

charging molten steel from a tundish into a mold through exit ports of an immersion nozzle;

introducing a magnetic field vertically to a flow of the molten steel from said exit ports by the use of at least a pair of direct current magnets which are arranged on the outer side of copper plates on the wide side of the mold, the immersion nozzle being placed between said direct current magnets and polarities of magnetisms on the top side of said magnets being the same; and casting the molten steel at a predetermined casting rate.

The above objects and other objects and advantages of the present invention will become apparent from the detailed description which follows, taken in conjunction with the appended drawings.

BRIEF DESCRIPTION OF THE DRAWINGS

FIG. 1(*b*) is a transverse sectional view of the mold taken on line 1—1 in FIG. 1(*a*);

FIG. 1(*c*) is a perspective view schematically illustrating a magnet in FIG. 1(*a*);

DESCRIPTION OF THE PREFERRED EMBODIMENT

Figure 6:
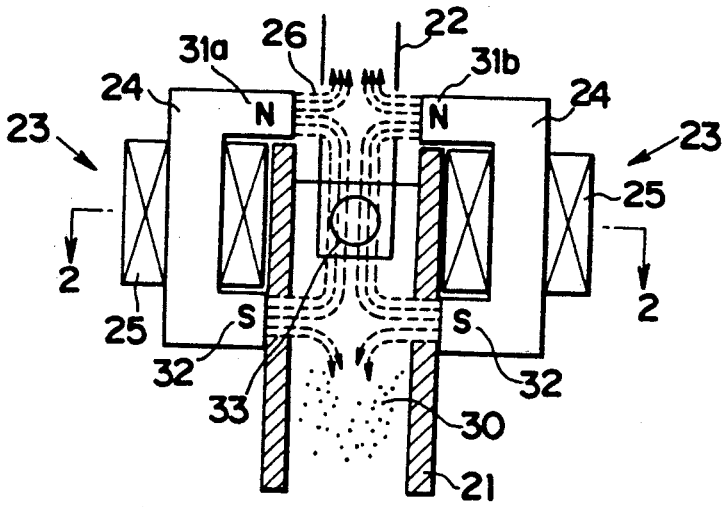
FIG. 6(*a*) and FIG. 6(*b*) are schematic illustrations of the state of flow of molten steel in the case of introducing an electromagnetic force on the molten steel in the mold of the present invention.
Figure 6:
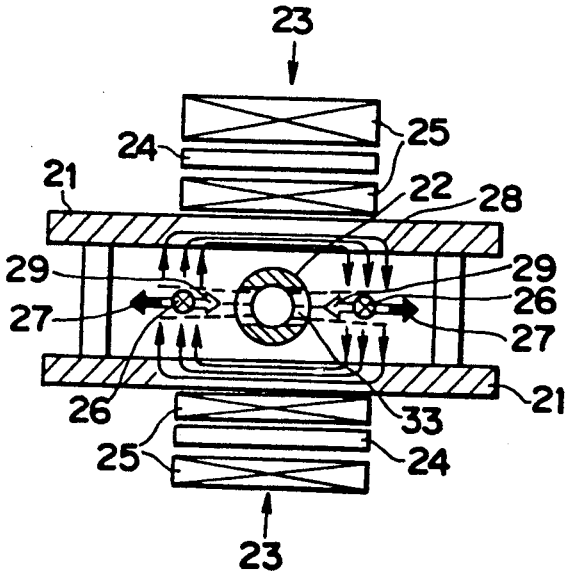
Figure 7:
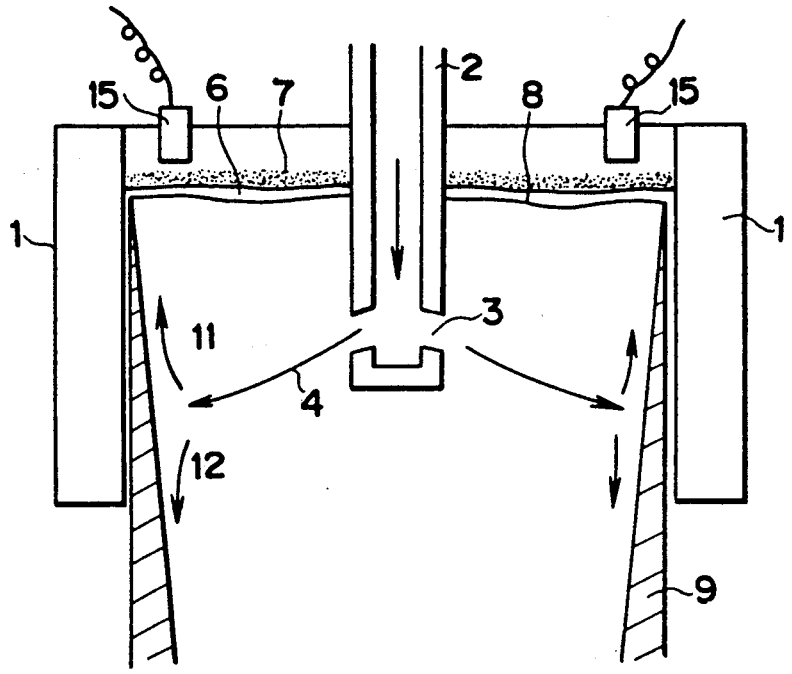
FIG. 7 PRIOR ART
FIG. 7 is a vertical sectional view schematically illustrating the flow of molten steel from the immersion nozzle into the mold in the prior art slab continuous caster.
Figure 8:
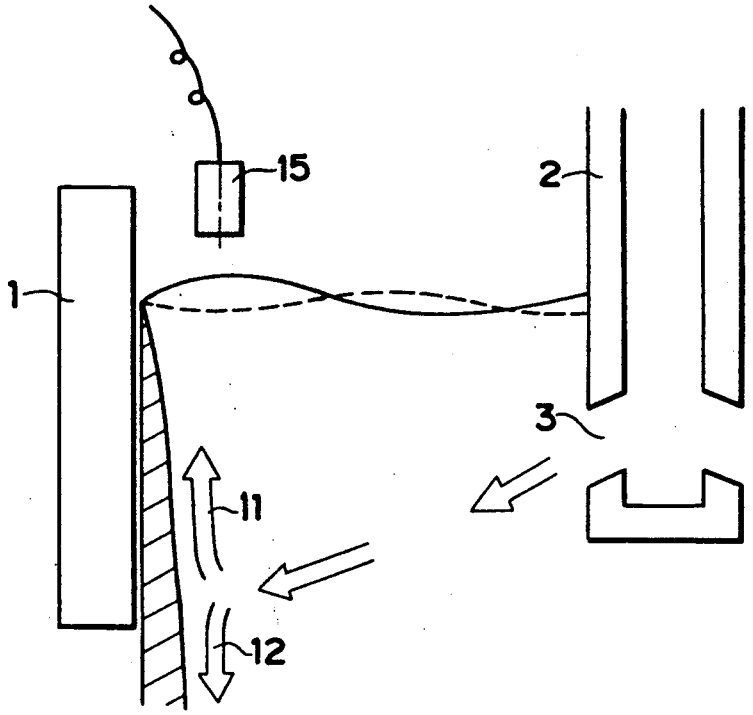
FIG. 8 PRIOR ART
FIG. 8 is a schematic illustration showing the wavy motion of molten steel surface in the prior art mold.
Figure 9:
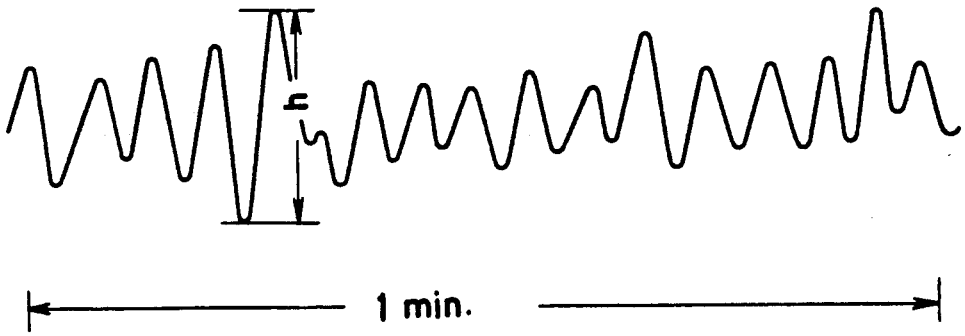
FIG. 9 is a schematic illustration showing the change of level of molten steel surface for about one minute according to the present invention.
Figure 10:
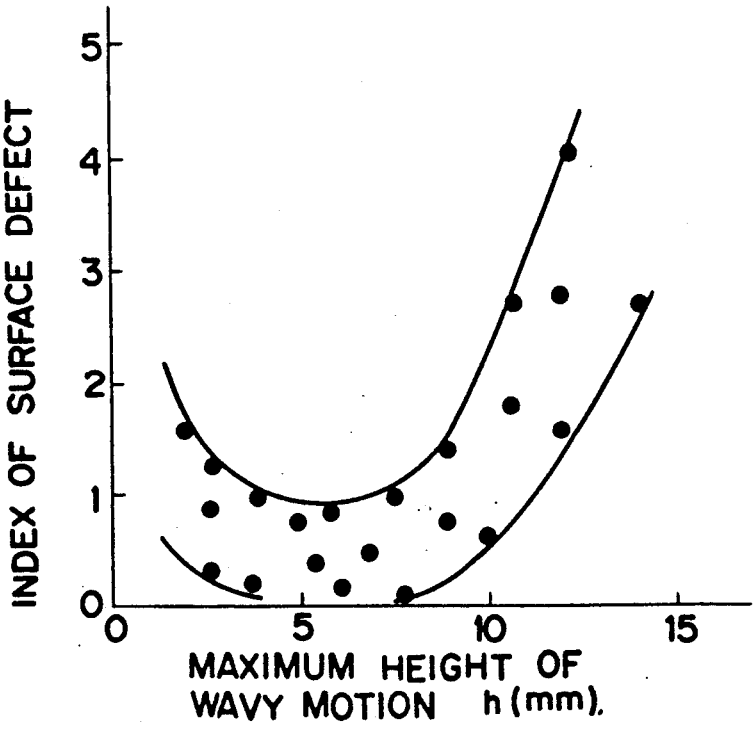
FIG. 10 is a graphical representation showing the relationship between the maximum height of molten steel surface and index of surface defect of hot-rolled steel plate according to the present invention.

In the present invention, a direct current magnetic field is vertically introduced to the flow of molten steel poured from exit ports of the immersion nozzle in a mold of continuous casting. When an electroconductive fluid flows in an electromagnetic field, an electromotive force is produced by Fleming's right-hand rule and an eddy current is generated. The movement of the fluid is hindered by the electromagnetic force generated in a direction opposite to that of the movement of the fluid on the basis of Fleming's right hand rule caused by eddy currents and the induced magnetic field. As a result, the rate of flow of molten steel is decreased. When the rate of the flow of molten steel poured from the exit ports is decreased, a flow rate of a turn-over flow of molten steel after the flow of molten steel has struck a shell on the narrow side of the mold is decreased, by which the wavy motion of the molten steel surface becomes hard to maintain. Moreover, when there occurs a single flow phenomenon in which molten steel flows out of mainly one of the two exit ports, a larger electromagnetic force works on the flow of molten steel having the larger flow rate. As a result, the single flow phenomenon is suppressed. When a direct current magnetic field is vertically introduced to the flow of molten steel, the eddy current forms a circuit around the immersion nozzle as shown in FIG. 6(*b*). Since electric current flows in a copper plate of the mold having an electric resistance of $2.5\times10^{-8}\Omega\cdot m$ as a part of circuit of the eddy current, the electric resistance of the circuit is decreased and the current density can be increased. As a result, the produced electromagnetic force is increased. The electromagnetic force can be effectively produced. when the direct current magnetic force is introduced to the flow of molten steel horizontally in the same direction as that of the narrow side of the slab, the produced eddy current forms a circuit on the surface parallel with the copper plate of the mold. Since the molten steel has large electric resistance of $150\times10^{-8}\Omega\cdot m$, the electric resistance of the circuit is increased and the density of eddy current is decreased. Accordingly, the direct current magnet is arranged so that the direct current magnetic field can be vertically introduced to the flow of molten steel. One magnetic pole is positioned at just above the upper end of the copper plate on the wide side of the mold and the other magnetic pole is positioned at lower than the exit port of immersion nozzle behind the copper plate on the wide side of the mold.

The present inventors' viewpoint on the flow of molten steel in the case of introducing the electromagnetic force on the molten steel will be described as follows. FIG. 6 is a schematic illustration showing a state of flow of molten steel in the case of introducing an electromagnetic force on the molten steel in the mold. FIG. 6(*a*) is a vertical sectional view illustrating the inside of the mold. FIG. 6(*b*) is a transverse sectional view of the inside of the mold taken on line 2—2 of FIG. 6(*a*). In the drawing, reference numeral 21 denotes a copper plate of the wide side of the mold, 22, an immersion nozzle, 23, a magnet, 24, a magnetic core, 25, a magnet coil, 30, molten steel, 31, one magnetic pole of the magnet, 32, the other magnetic pole of the magnet and 33, an exit port of the immersion nozzle. Magnetic field 26 is shown with dotted lines having arrow symbol in FIG. 6(*a*) and with symbol in FIG. 6(*b*). Flow 27 of molten steel poured from exit ports is shown with black arrow symbols in FIG. 6(*b*). Eddy current 28 is shown with solid lines having arrow symbol in FIG. 6(*b*). Braking force 29 is shown with white arrow symbols in FIG. 6(*b*).

Molten steel is poured from a tundish into the mold through the immersion nozzle 22. At least a pair of magnets 23 are arranged so that the immersion nozzle 22 can be positioned between the magnets 23. The magnet is constituted by the magnetic core 24 and the magnet coil 25. One magnetic pole of the magnet 24 is arranged just above the upper end of the wide side copper plate of the mold. The other magnetic pole 32 of the magnet is arranged at lower than the exit port 33 of the immersion nozzle behind the wide side 21 of the mold. For example, reference numerals 31*a* and 31*b* denote N poles and 32*a*, and 32*b*, S poles. The polarities of the magnetic poles facing each other are the same. The braking force 29 working in the direction opposite to the movement of the flow of molten steel poured from exit ports is produced in the flow 27 of molten steel by vertically introducing magnetic field 26 to the flow 27. The flowing rate of flow 27 is decreased by the braking force 29.

When the direct current magnetic field is introduced to flowing molten steel 30, electromotive force E is produced according to the following formula:

$$E=V\times B=V_Y\cdot B_Z \quad \ldots (1)$$

V: the flowing rate of molten steel (m/sec)

B: the magnetic flux density $V_Y$: element of the flowing rate in the direction of the width of the mold $B_Z$: element of the magnetic flux density in the vertical direction Eddy current I flows in the molten steel under the influence of the electromotive force E and the braking force F works in the direction opposite to the movement of the molten steel under the mutual work of the eddy current E and the magnetic flux density.

$$F=-I\times B=-\alpha V_Y\cdot B_{Z2} \quad (2)$$

$\alpha$: the electric resistance of fluid ($\Omega\cdot m$)

The braking force depends on $V_Y$ and $B_{Z2}$ from the formula (2).

Since $V_Y$ is small in the case of continuous casting of steel at a low rate, the braking force F working on the molten steel is small. However, since $V_Y$ becomes large with the increase of the rate of continuous casting, the braking force F becomes large.

Relative to the flow 27 poured from the immersion nozzle 22, a single flow phenomenon, in which the molten steel flows out of mainly one exit port 33 in case there is no direct current magnetic field, is liable to occur. Since a greater braking force works on the flow of molten steel having a larger flow rate of molten steel under the direct current magnetic field introduced vertically to the flow of molten steel poured from the immersion nozzle according to the formula (2), the flow from both exit ports are equalized and the single flow of molten steel is decreased. As a result, the maximum height of wavy motion of molten steel surface can be controlled to be within a predetermined range.

The magnetic field can be controlled by measuring the wavy motion of molten steel surface in the mold by the use of an eddy current type distance measuring device arranged above the molten steel and controlling electric current in the coil of direct current magnet on the basis of the values obtained by the measurement. The height of wavy motion of molten steel surface is controlled within the predetermined range. The trapping of mold powder by the wavy motion of molten steel surface is decreased.

The magnetic field vertically introduced to the flow of molten steel is controlled depending on the casting rate. The magnetic field of about 1000 to 4000 gauss is desired when the casting rate is from 2.5 to 8 ton/min. When the magnetic field is less than 1000 gauss, it cannot effectively control the height of wavy motion of molten steel surface. When the magnetic field exceeds 4000 gauss, capacity of the direct current magnet is excessively large, which causes increase of the equipment.

EXAMPLE

Figure 1:
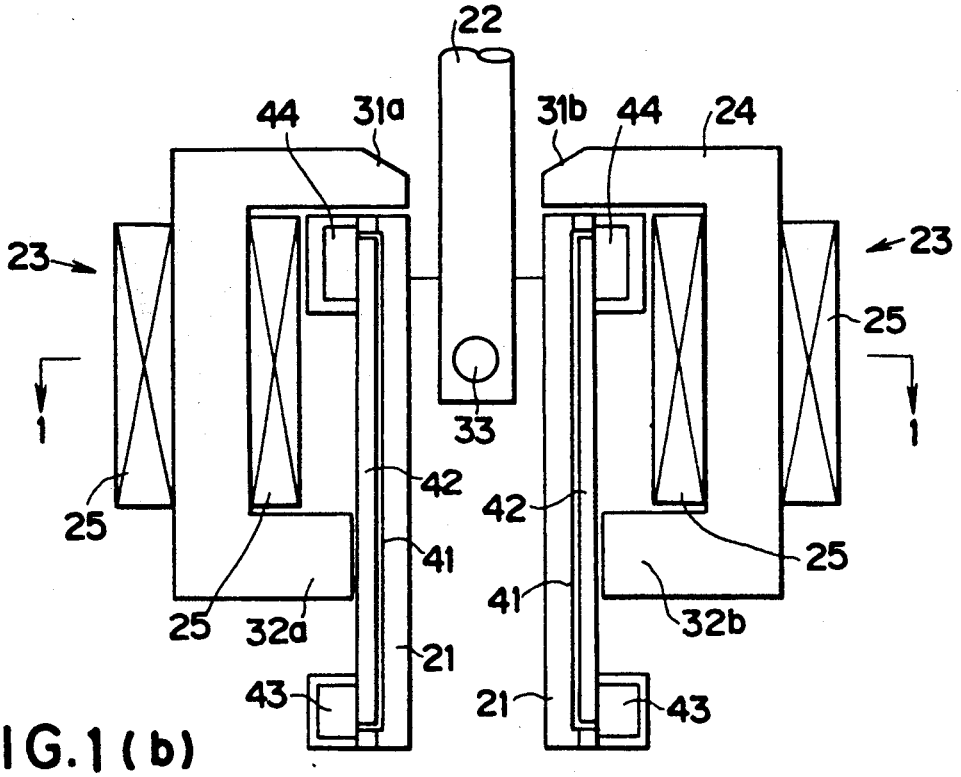
FIG. 1(*a*) is a vertical longitudinal sectional view illustrating a mold for continuous casting of steel used for execution of the present invention.
Figure 1:
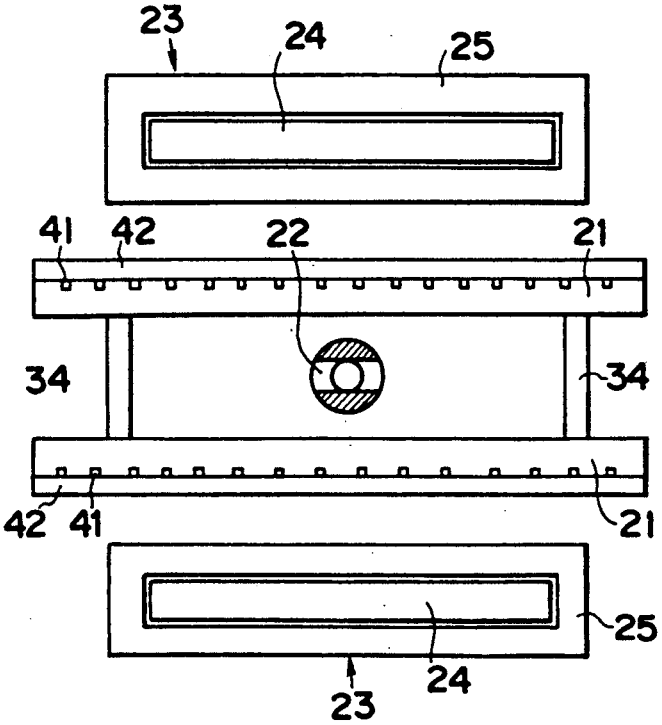
Figure 1:
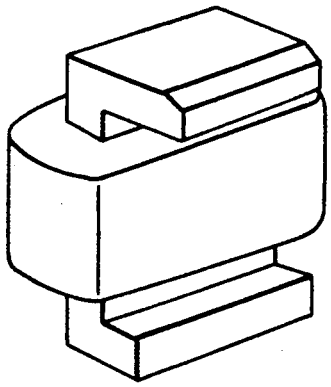

Referring now specifically to the appended drawings, a mold for continuous casting of steel which was used for executing the method of the present invention will be described. FIG. 1 (*a*) is a vertical longitudinal sectional view illustrating the mold for continuous casting of steel used for the execution of the present invention. FIG. 1 (*b*) is a transverse sectional view of the mold taken on line 1—1 in FIG. 1 (*a*). FIG. 1 (*c*) is a perspective view schematically illustrating a magnet in FIG. 1 (*a*). In the drawing, reference numeral 21 denotes a copper plate on the wide side of the mold, 22, an immersion nozzle, 23, a magnet, 24, a magnetic core, 25, a direct current magnet coil, 30, molten steel, 31, one magnetic pole of the direct current magnet, 32, the other magnetic pole of the direct current magnet and 33, an exit port of the immersion nozzle, 41, a cooling water path, 42, a back plate constituting the cooling water path 41 between the back plate and the wide side copper plate 21 of the mold, 43, water box for supplying cooling water, and 44, a water box for discharging cooling water.

A pair of the magnets 23 were arranged behind the wide side copper plate 21 of the mold, the immersion nozzle 22 being between the pair of magnets. The magnet 23 was constituted by the magnetic core 24 and direct current magnet coil 25. One magnetic pole 31 of the direct current magnet was arranged just above the upper end of the wide side copper plate 21 of the mold and the other magnetic pole 32 of the direct current magnet at the hight of about 300 mm below the exit port 33 of the immersion nozzle on the outer side of copper plate 21 of the mold. Dimensions of a section of the magnetic core 24 was determined so that the magnetic field could be introduced to the whole mold and so that the magnetic pole 31 arranged just above the upper end of the wide side copper plate of the mold could not hinder any casting operation inside the mold. That is, the magnetic pole 31 on the upper side had a height of 70 mm and a width of 1100 mm and an upper corner of the magnetic pole was cut off. The magnetic pole on the lower side had a height of 100 mm and a width of 1100 mm. The polarities of the direct current electromagnets 23 were selected so that the polarities of magnetic poles 31*a* and 31*b* were the same. In this way, a magnetic field in the vertical direction could be produced in the mold. The back plate is preferred to be made of stainless steel which is a non-magnetic metal. The magnetic field inside the mold can be effectively produced with no influence by the back plate. Moreover, the direct current electromagnet 23 together with the mold are mounted on an oscillation table (not shown) and oscilated in the up-and-down direction.

EXAMPLE-1

Figure 2:
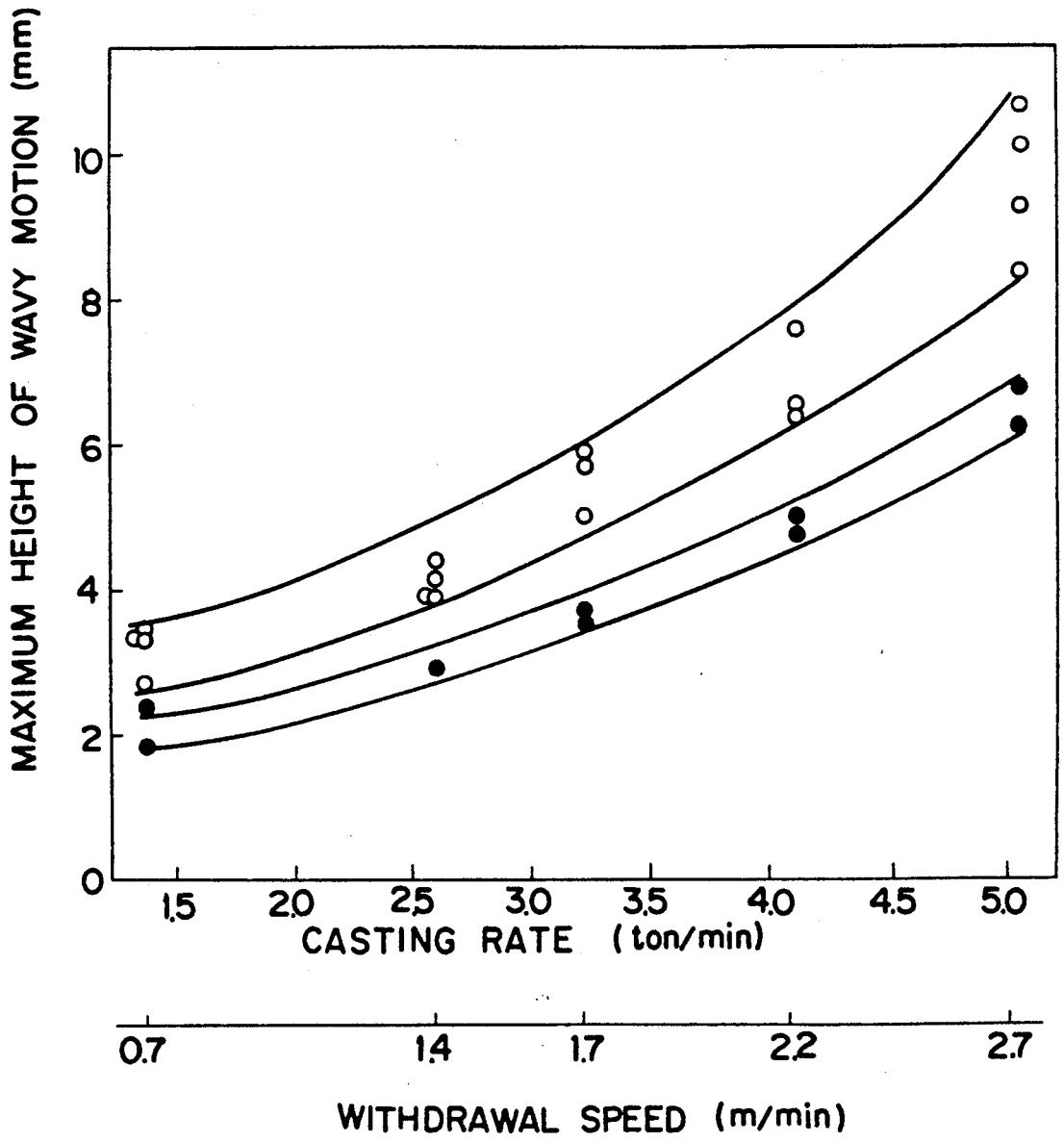
FIG. 2 is a graphical representation indicating the relationship between the casting rate or the withdrawal speed and the maximum height of the wavy motion of molten steel surface in Example-1.

The height of wavy motion of molten steel surface near copper plate 34 on the narrow side of the mold was measured during casting of steel by the use of a continuous caster in which a pair of magnets 23 shown in FIG. 1 were arranged. Molten steel was cast into a slab of sectional dimension of 220 mm in thickness and 1200 mm in width at a withdrawal speed of 0.7 to 2.7 m/min. A casting rate during casting was changed with the rate from 1.4 t to 2.7 ton/min. FIG. 2 is a graphical representation indicating the relationship between the casting rate or the withdrawal speed and the maximum height of a wavy motion of molten steel surface in the case of introducing and not introducing the direct magnetic field to the flow of molten steel poured from the immersion nozzle. The abscissa in FIG. 2 denotes the withdrawal speed and the casting rate. Symbol means no application magnetic field. Symbol means the application of the magnetic fields. The magnetic flux density was controlled within a range of 2000 to 2500 gauss. The maximum height of wavy motion of molten steel surface in the case of introducing the magnetic field to the flow of molten steel became considerably small compared with the maximum height of wavy motion of molten steel in the case of not introducing the magnetic field to the flow of molten steel. When the casting rate was 2.5 ton/min, the maximum height of wavy motion of molten steel was limited to 4 mm or less. On the other hand, even when the maximum height of wavy motion of liquid steel was 2.5 ton/min or more, the maximum height of wave motion of molten steel could be limited to 8 mm or less.

EXAMPLE-2

Figure 3:
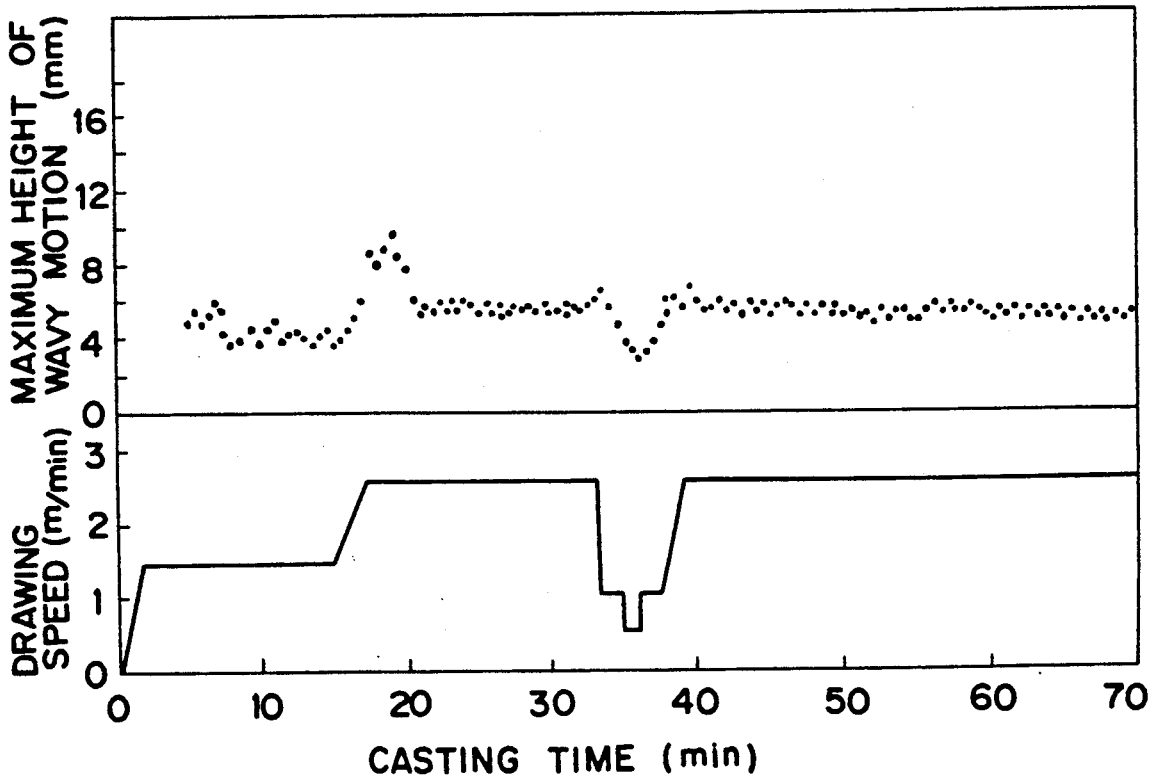
FIG. 3 is a graphical representation indicating the relationship between the withdrawal speed and the maximum height of the wavy motion of molten steel surface in Example-2.

A continuous casting was carried out by introducing the direct current magnetic field to the flow of molten steel poured from the immersion nozzle by the use of a mold of continuous caster in which a pair of magnets shown in FIG. 1 were arranged. Conditions of introducing the direct current magnetic field were judged from the results in Example-1. That is, the magnetic flux density at a casting rate of 3.0 ton/min or more was determined at 2000 gauss. In this way, the molten steel was cast into a slab of sectional dimensions of 220 mm in thickness and 1200 mm in width. FIG. 3 shows the timewise change of the withdrawal speed and the maximum height of wavy motion of molten steel. The magnetic field was not introduced to the flow of molten steel for 20 to 30 minutes after the start of casting. The magnetic field of 2000 gauss was introduced to the flow of molten steel for 20 to 33 minutes after the start of casting. The magnetic field was not introduced to the flow of molten steel for 33 to 40 minutes after the start of casting to change one ladle for the other. The magnetic field of 2000 gauss was introduced to the flow of molten steel 40 minutes later after the start of casting. It was necessary to set the eddy current type distance measuring device and to adjust it to measure the maximum height of wavy motion of molten steel after the start of continuous casting of steel. Therefore, the maximum height of wavy motion of molten steel surface could not be measured. When the maximum height of wavy motion of molten steel surface was enabled to be measured and the magnetic field was introduced to the flow of molten steel, the maximum height of wavy motion of molten steel surface could be controlled in the entire range of casting. The wavy motion of molten steel surface was small due to the decreased flow rate during the change of one ladle for the other. Therefore, it was not necessary to introduce the direct current magnetic field to the flow of molten steel to cause the magnetic field to work on the flow of molten steel.

Figure 4:
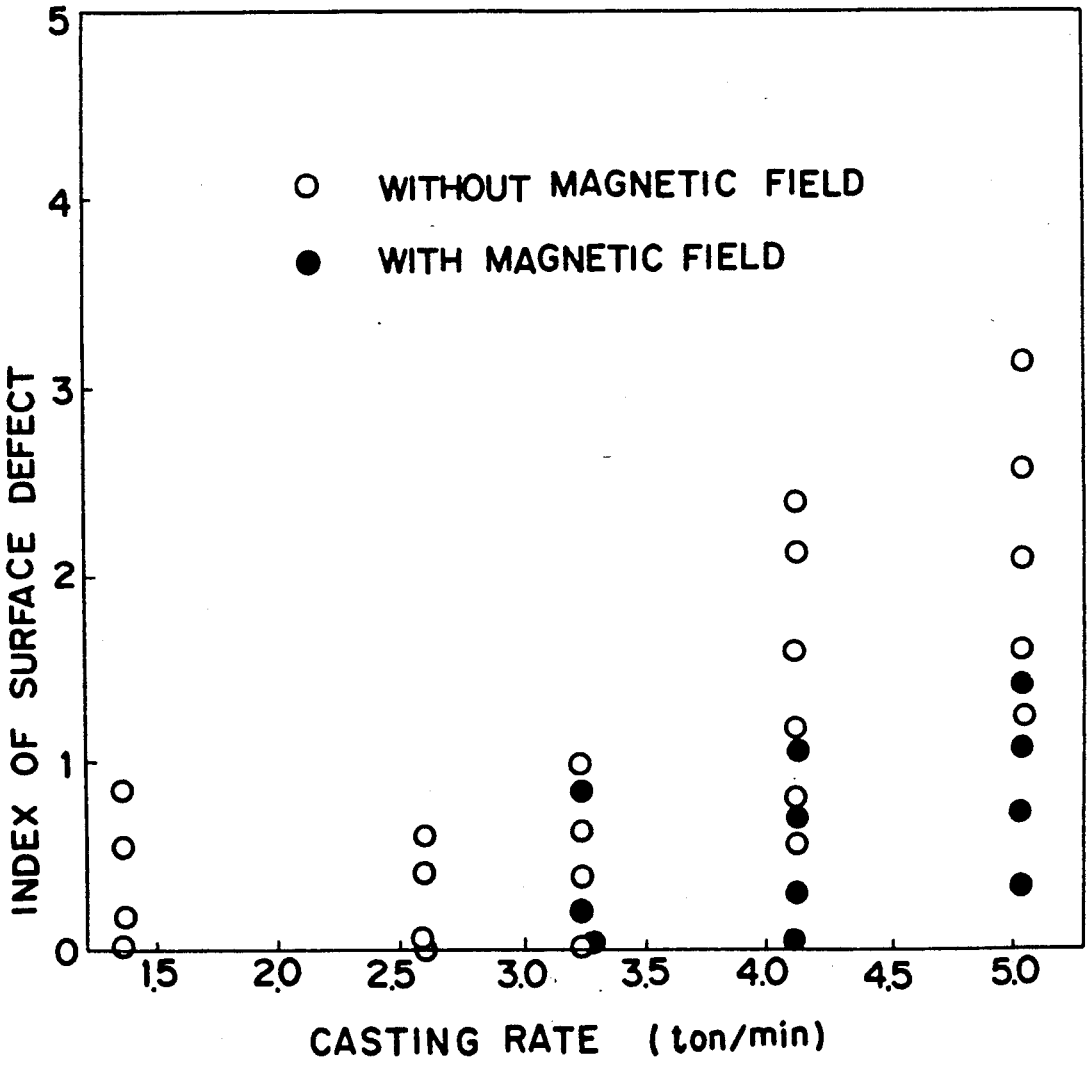
FIG. 4 is a graphical representation indicating the relationship between the casting rate and the index of surface defect of hot-rolled plate in cases of introducing and not introducing direct current magnetic field to the flow of molten steel in Example-2.

FIG. 4 is a graphical representation showing the relationship between the casting rate and the index of surface defect of hot-rolled steel plate. Symbol denotes the case when the magnetic field was not introduced to the flow of molten steel and symbol the case when the magnetic field was introduced to the flow of molten steel. The direct current magnetic field was introduced to the flow of molten steel at a casting rate of 3.0 ton/min. The index of surface defect of hot-rolled steel plate is the value which is obtained by dividing the number of spills by the observed area. As clearly seen from FIG. 4, the index of surface defect of hot-rolled steel plate was greatly decreased in the high-speed continuous casting of steel.

EXAMPLE-3

Molten steel was cast into aluminium-killed low-carbon steel by the use of a mold of 220 mm in thickness and 1400 mm in width. The aluminium-killed low-carbon steel had a content of 0.04 to 0.05 wt. % C, 0.01 to 0.02 wt. % Si, 0.22 to 0.26 wt. % Mn, 0.012 to 0.018 wt. % P, 0.013 to 0.016 wt. % S and 0.028 to 0.036 wt. % sol. Al. The withdrawal speed was changed within a range of 1.8 to 2.7 m/min. The direct current magnetic field was introduced to the portion near the exit port of the immersion nozzle in the same way as that shown in Example-1. The eddy current type distance measuring device was mounted in the corner portion of the mold and the height of wavy motion of molten steel was measured. The corner portion was positioned 50 mm away from the wide side of the mold and 50 mm away from the narrow side of the mold. The nozzle used had two exit ports. Angles of discharge were 15°, 25°, 35° and 45° downwards relative to the horizontal plane. The immersion nozzle was immersed into molten steel constantly to the depth of 210 mm. The depth of immersion was a distance from the molten steel surface to the upper end of exit port of immersion nozzle.

Figure 5:
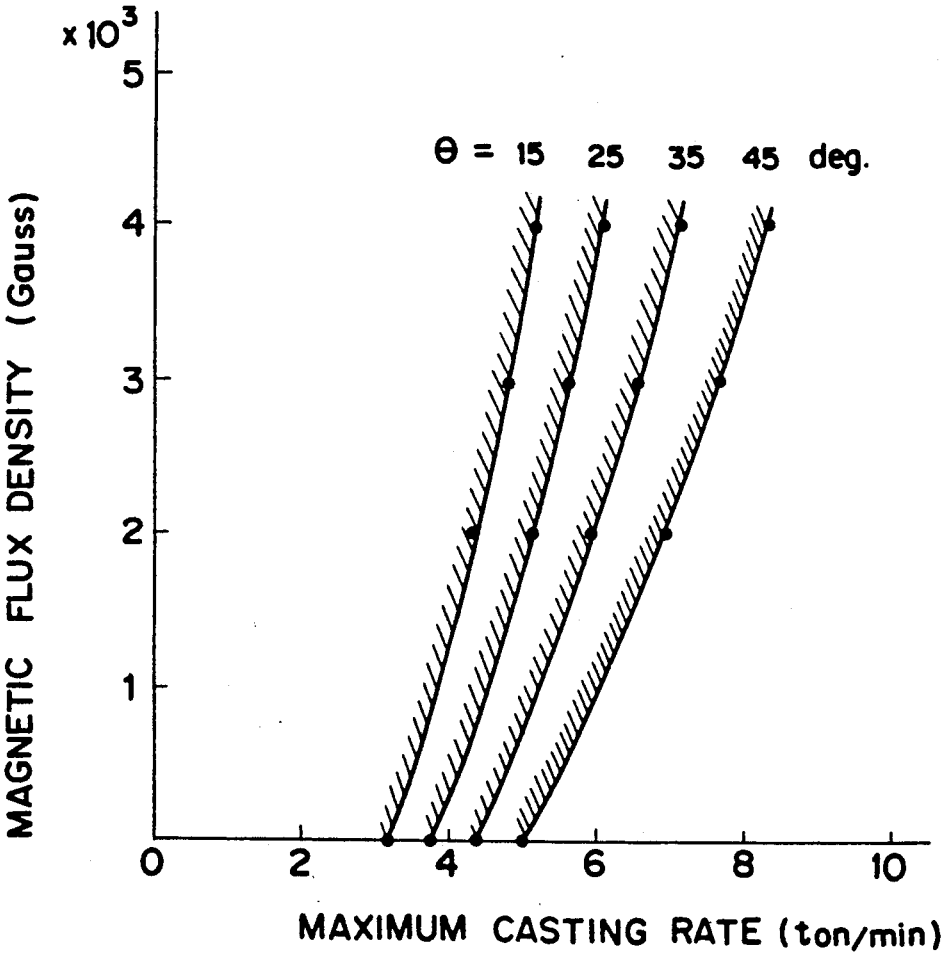
FIG. 5 is a graphical representation showing the relationship between the maximum casting rate and the magnetic flux density with the angle of the opening of the immersion nozzle as a parameter.

The height of wavy motion of molten steel surface is desired to be 8 mm or less in order that any entanglement of powder with the molten steel is not produced. Accordingly, the magnetic flux densities necessary for limiting the height of wavy motion of molten steel surface were found with respect to the angles of the exit port of the immersion nozzle and the casting rate. The results obtained are shown in FIG. 5. A portion shown with oblique lines in FIG. 5 is a range where a good slab by which powder has not been trapped is produced.

The angle of exit port of the immersion nozzle is desired to be 15° to 45°. When the angle is less than 15°, it is difficult to control the height of molten steel surface in case the withdrawal speed is large. When the angle is over 45°, the flow of molten steel from the immersion nozzle is injected under the bottom of the mold.

Next, the same aluminium-killed low-carbon steel as described above was manufactured by the use of a mold of 220 mm in thickness and 1400 mm in width. Molten steel was cast into the steel at a withdrawal speed of 2.5 m/min. The withdrawal speed corresponds to a casting rate of 5.5 ton/min. The immersion nozzle used had two exit ports. An angle of the exit port of the immersion nozzle was 35°. A depth of immersion of the immersion nozzle was 210 mm. The ratio of occurrence of flaws of products in the case of casting in both of the states of the flows of molten steel, to which the direct current magnetic field was introduced and not introduced, was studied. The ratio of occurrence of flaws of products in the case of introducing the direct current magnetic field to the flow of molten steel was about one third of that of the case of not introducing the direct current magnetic field to the flow of molten steel. In consequence, the effect of introducing the direct current magnetic field was proved.

What is claimed is:

1. A method for continuously casting steel in a mold having a pair of wide sides and a pair of narrow sides, comprising:
   - charging molten steel from a molten steel source into said mold through at least one exit port of an immersion nozzle that is positioned in said mold;
   - positioning at least one pair of direct current magnets adjacent said pair of wide sides of said mold, said nozzle being positioned in said mold between said at least one pair of direct current magnets;
   - each of said pair of direct current magnets having end portions that have polarities that are opposite to each other;
   - placing the same polarity end portions of each of said magnets to face each other;
   - energizing said at least one pair of direct current magnets to generate a magnetic field in said molten steel exiting from said at least one exit port, said magnetic field being generated in a plane that is substantially perpendicular to the direction of flow of said molten steel, and
   - casting said molten steel at a predetermined rate.

2. The method according to claim 1, wherein said mold is formed from a non-magnetizable metal.

3. The method according to claim 2, wherein said non-magnetizable metal is copper.

4. The method according to claim 2, wherein each of said pair of direct current magnets is generally U-shaped, and wherein like polarity arms of each of said U-shaped magnets are positioned to face each other with said nozzle therebetween.

5. The method according to claim 4, wherein each of said U-shaped magnets has a longer arm and a shorter arm, and wherein said longer arm of both of said direct current magnets have the same polarity.

6. The method according to claim 5, wherein said longer arms of said U-shaped magnets are positioned to face each other above said non-magnetizable metal mold, and wherein said shorter arms of said U-shaped magnets face each other with said non-magnetizable metal mold sandwiched therebetween.

7. The method according to claim 6, wherein said non-magnetizable metal is copper.

8. The method according to claim 1, wherein said direct current magnets have one pair of like polarity end portions positioned above said at least one exit port and another pair of like polarity end portions positioned below said at least one exit port.

9. The method according to claim 1, wherein said molten steel being charged into said mold has a top surface, and wherein said top surface has waves formed therein as a result of said charging of said molten steel into said mold; and wherein the waviness of said waves increases with the rate of casting.

10. The method according to claim 9, further comprising the steps of:
   - measuring said waviness of said molten steel surface; and
   - energizing said at least one pair of direct current magnets based on said measured waviness to control the waviness of said molten steel surface to fall within a preselected range.

11. The method according to claim 1, wherein said mold has a pair of backplates made of non-magnetic metal, and the method comprises the additional steps of:

forming cooling water channels in said mold by respectively positioning each of said pair of backplates adjacent and parallel to but spaced from each of said pair of wide sides of said mold; and supplying water to and discharging water from said channel.

12. The method of claim 1, wherein the magnetic flux lines of each of said direct current magnets exist between the end portions of each of said direct current magnets, and do not move across said narrow sides of said mold.

13. The method of claim 12, wherein said flux lines of each of said direct current magnets are parallel to the wide sides of said mold.

14. The method of claim 1, wherein said immersion nozzle has two exit ports, each of which has an angle of 15° to 45° downward from the horizontal plane.

15. The method of claim 1, wherein said direct current magnetic field is controlled to be within a range of 1000 to 4000 gauss.

16. The method of claim 1, wherein said immersion nozzle has two exit ports, each of which has an angle of 15° to 45° downward from the horizontal plane;

said direct current magnetic field is controlled to be within a range of 1000 to 4000 gauss, and said casting rate is controlled to be within a range of 2.5 to 8 ton/min.

* * * * *